US007289639B2

(12) United States Patent
Abel et al.

(10) Patent No.: US 7,289,639 B2
(45) Date of Patent: Oct. 30, 2007

(54) HEARING IMPLANT

(75) Inventors: Eric Abel, Dundee (GB); Zhigang Wang, Dundee (GB); Robert Mills, Edinburgh (GB)

(73) Assignee: Sentient Medical Ltd (GB)

( * ) Notice: Subject to any disclaimer, the term of this patent is extended or adjusted under 35 U.S.C. 154(b) by 0 days.

(21) Appl. No.: 10/502,367

(22) PCT Filed: Jan. 24, 2003

(86) PCT No.: PCT/GB03/00264

§ 371 (c)(1),
(2), (4) Date: Mar. 2, 2005

(87) PCT Pub. No.: WO03/063542

PCT Pub. Date: Jul. 31, 2003

(65) Prior Publication Data

US 2005/0163333 A1 Jul. 28, 2005

(30) Foreign Application Priority Data

Jan. 24, 2002 (GB) ..... 0201574.1

(51) Int. Cl.
*H04R 25/00* (2006.01)

(52) U.S. Cl. ..... 381/312; 381/326

(58) Field of Classification Search ..... 381/312, 381/314, 315, 322, 323, 326, 328, 380, 190; 600/25; 607/55, 56, 57
See application file for complete search history.

(56) References Cited

U.S. PATENT DOCUMENTS 3,764,748 A * 10/1973 Branch et al. ..... 607/57
5,279,292 A 1/1994 Baumann et al. ..... 607/137
5,879,283 A 3/1999 Adams et al. ..... 600/25
5,984,859 A * 11/1999 Lesinski ..... 600/25
6,001,129 A 12/1999 Bushek et al. ..... 623/10
6,137,889 A 10/2000 Shennib et al. ..... 381/328
6,261,224 B1 7/2001 Adams et al. ..... 600/25
6,537,200 B2 3/2003 Leysieffer et al. ..... 600/25

FOREIGN PATENT DOCUMENTS

DE 28 44 979 A1 4/1980
DE 35 08 830 A1 9/1986
JP 60154800 8/1985
WO WO 97/32385 A1 9/1997
WO WO 00/76271 A1 12/2000

OTHER PUBLICATIONS

Leirner AA, Oshiro MS, Nunes CA, Bento Ref, Miniti A. (ENT Dept., Medical School, University of Sao Paolo, Brazil) "A pathway for information transmission to the inner ear. Application to cochlear implants." Asaio J. Jul.-Sep. 1992; 38(3):M253-6.

* cited by examiner

*Primary Examiner*—Huyen Le
(74) *Attorney, Agent, or Firm*—Gifford Krass Sprinkle Anderson & Citkowski

(57) ABSTRACT

The present invention relates to a hearing aid system comprising a hearing implant and a method of powering a hearing implant, the system comprising an external ear canal module and an implant, wherein the signalling and/or powering of the ear implant is by way of a light signal being provided to the implant through the ear drum from, for example, the ear canal module.

17 Claims, 2 Drawing Sheets

HEARING IMPLANT

FIELD OF THE INVENTION

The present invention relates to a hearing aid system comprising a hearing implant and method of powering a hearing implant.

BACKGROUND OF THE INVENTION

Sensorineural deafness is by far the most common type of hearing loss. Deafness affects 9 million people in the United Kingdom, of which about 95% have sensorineural deafness (source Defeating Deafness, United Kingdom). Causes include congenital, bacterial, high intensity noise and, especially, the ageing process, with 30 percent of those affected being over 60 years. Hearing impairment is the third most common chronic problem affecting the ageing population—and one of the least diagnosed. There is also an increased prevalence in some sections of the younger age group, due to exposure to loud noise.

There are currently no effective means of repairing the cochlea or the nervous pathways to the brain. For most patients, hearing can be restored adequately by sufficient amplification of sound with a hearing aid. Hearing aids have a number of problems: acoustic feedback (because the microphone is very close to the speaker), inadequate sound quality, and discomfort due to occlusion of the ear canal. They also are undesirable from the social point of view, in that the appearance of wearing a hearing aid can cause users to feel that they are seen to be handicapped. The alternative is an implantable device.

Middle ear implants provide mechanical amplification by vibrating the ossicular chain. They are intended for patients with moderate to severe sensorineural hearing loss, who still have residual hearing. They could potentially benefit up to 50% of all people with hearing loss. Cochlear implants, the alternative, provide electrical stimulation to the nerves of the inner ear, but are suitable only for the profoundly deaf, as all residual hearing is destroyed during their implantation. They are not favoured where there are alternative solutions.

Middle or inner ear implants however require a power supply. A few use incorporated batteries, which although last several years, require replacement. This undesirably necessitates a further operation for the patient. Other implants use wires through the skull and the rest use radiofrequency or inductively coupled methods. Nevertheless, radio frequency modulated transmission uses complicated circuitry, is cumbersome and costly, and the implanted receiver module itself has a heavy demand on power. It also has to be approved under each country's radiofrequency regulations. Inductively coupled transmission methods use two coils or one coil and one magnet separated in close proximity. However, problems include high power consumption, signal variations and background noise. Moreover, MRI compatibility can also be a problem with some components.

It is an object of the present invention to obviate and/or mitigate at least one of the aforementioned disadvantages and/or problems.

SUMMARY OF THE INVENTION

Broadly speaking the present invention is based on powering a middle or inner ear implant using a light signal.

In a first aspect the present invention provides a hearing aid system comprising an external ear canal module and an implant;

the external ear canal module comprising a microphone, a light source, a power source and necessary electronic circuitry;

the implant comprising a photoreceiver actively coupled to a hearing actuator; and wherein in use, sound detected by the microphone of the external ear canal module is converted and transmitted by the light source as a modulated light signal, the modulated light signal being detected by the photoreceiver of the ear implant and converted to an electrical signal for driving the hearing actuator.

The implant it will be understood is located within the middle or inner ear, i.e the body side of the ear drum.

Advantageously the present system is such that the light signal may be sufficient to not only provide the sound information, but also power the ear implant. In this manner, the ear implant need not have its own internal power source. Alternatively or additionally a further light source may be used to charge a battery within the ear implant so as to provide additional power to the implant.

Thus, in a further aspect, the present invention provides a method of powering and/or signalling an ear implant comprising transmitting a light source, or sources through a patients ear drum, such that said light source(s) is/are received by the ear implant and wherein said light source(s) is/are capable of powering and/or signalling the ear implant.

The components of the external ear canal module are typically contained within a single housing which is shaped to fit within the external ear canal. The microphone is positioned within the housing such that in use it can easily detect sounds. Thus, the microphone is generally arranged to be directed towards the outside of the ear for receiving sound. The sound received by the microphone is transduced by appropriate means known to those skilled in the art, into an electrical signal which in turn is converted into a modulated signal by suitable modulating means. The modulated signal is then output as a modulated light signal from the light source.

The light source may be for example a light emitting diode (LED) and the light signal itself may be visible light or preferably near infrared (NIR) light or infrared (IR) energy. Studies have shown that IR light can penetrate over 15 mm of tissue at frequencies up to 30 KHz. The light which is output by the module is to be received by the middle-ear implant. Thus, the light source is arranged in use so as to emit the light in the direction of the photoreceiver. The light source therefore emits the light towards and through the ear drum for detection by the photoreceiver.

The skilled addressee is well aware of the electrical circuitry required for the module and a power source, typically a battery, rechargeable or otherwise, is required to power the components of the module.

Although generally designed to fit snugly within the external ear canal so as to not easily fall out, the module should conveniently not completely occlude the ear canal. In this manner a channel, valve or the like may be provided in the module so as to provide a passage through the module thereby preventing blockage of the ear canal. It is understood that such a channel valve or the like could be associated with the housing of the module and, for example, a channel could be cut into the external surface of the module.

The implant may be an integrated photoreceiver/actuator unit such as a micro electromechanical system (MEMS)-integrated photoreceiver/actuator. The photoreceiver/actuator may be a single unit, or the photoreceiver and actuator may be separate and electrically connected by wiring. The photoreceiver may be a photo-sensitive diode, photo voltaic cell or other type of photoreceiver which may be located anywhere in the middle ear, providing it can receive light generated from the light source of the ear canal module. It may be covered by a biocompatible coating, which could include coverage of the photoreceiver.

In order that a patient suffers no or minimal residual hearing loss, the implant may sit on the ossicular chain, rather than linking to it from a remote fixation, such that the only additional mechanical impedance is due to the small mass of the actuator itself. Locating the actuator on the ossicular chain may also help to eliminate any post-operative alterations to implant performance from tightening or loosening of the actuator-ossicle coupling during the healing of swollen tissues, and from small displacements arising from the altered gravitational effects of lying down during the operation and sitting/standing up afterwards.

The actuator may, for example, be located on the incus long process, the incudostapedial joint (which could be disarticulated temporarily without damage for the fitting of an annular shaped actuator) or the stapes. The actual design of the actuator will be determined by the skilled addressee according to the location selected, an important aim being to reduce acoustic feedback An alternative position may be in the inner ear, for example the promontory, where coupling may be direct, via fenestration: a surgical technique to create a window in the inner ear in order to contact the inner ear fluid directly, or using an external anchoring support.

The actuator may be secured in place by methods such as cementing, grafting or mechanical means, for example screws or barbs. It could be osseointegrated with the ossicular chain.

Actuation may be mechanically driven or electrical. In the middle ear, actuation will generally be mechanical vibration of the ossicular chain, or more specifically individual bones thereof. If the actuator is placed in the inner ear, actuation may be carried out mechanically by for example direct or indirect vibration of the perilymph fluid in the inner ear, or electrically to an electrode or electrode array, coupled for example to the cochlea.

In order to drive a mechanically operated actuator, light is received by the photoreceiver, which is in turn converted into an electrical output which drives the actuator resulting in vibrations. Typically the actuator may be a thin disk made of piezo ceramic material such as lead zirconate titanate (PZT), or lead lanthanum zirconate tibanate PLZT. This is desirable because the materials are magnetic resonance imaging (MRI) compatible, as well as being efficient transducers. Additionally more than one disk may be provided in a desired configuration and/or disk may be more than one layer thick. The vibrations may also be generated using for example a disk(s) of piezo ceramic in conjunction with a flexible diaphragm of for example stainless steel, titanium, or aluminium.

Furthermore, the use of a flexible diaphragm permits hydraulic amplification to increase the displacement of the flexible diaphragm. For example, an increase in the displacement of the flexible diaphragm can be obtained using a simple fluid-filled tube coupled to a larger diameter disk actuator which is located at the opposite end of the tube from the flexible diaphragm and may contact for example the perilymph. Such a tube structure allows the actuator module to be placed in the middle ear cavity which provides more space for accommodation and support.

BRIEF DESCRIPTION OF THE DRAWINGS

As an example, a PZT disc actuator now in use in an incus-driven middle ear implant operates at 1V and 100 μA. This power requirement could be generated from the photodetector without the need for further electronic amplification. Passive RC filtering could be used for demodulation. In case a higher voltage or current is needed to drive the actuator, a simple op-amp would be sufficient which will consume very little extra power other than to drive the actuator. The additional power could come from another modulated source or a DC frequency in the light signal.

An embodiment of the present invention will now be described in more detail and with reference to the following FIG..

DETAILED DESCRIPTION OF THE PREFERRED EMBODIMENTS

Figure 1:
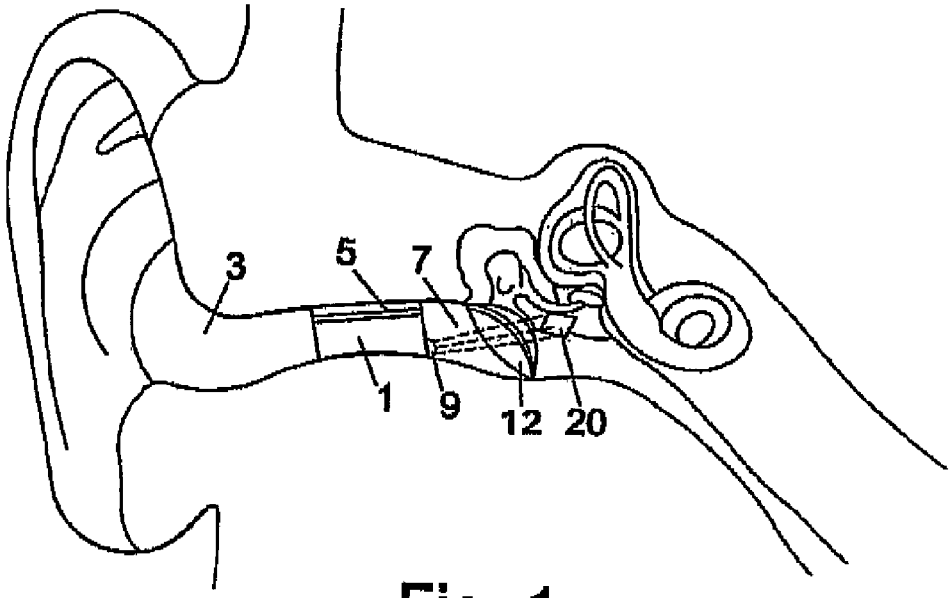
FIG. 1 shows the possible locations of an ear canal module and ear implant according to the present invention.

FIG. 1 shows somewhat schematically the relative locations of the external ear canal module 1 and ear implant 20. As can be seen, the ear module 1 is located in the ear canal 3. The ear module 1 has a channel 5 through the module 1 in order to prevent occlusion of the ear canal 3. A modulated IR light signal, represented by the dashed lines 7, is emitted by an LED 9, through the ear drum 12, so as to be detected by an implant 20. In this embodiment, the implant 20 sits on the incudostapedial joint, so as to oscillate the stapes, although the implant could be located elsewhere, for example in the promontory.

Figure 2:
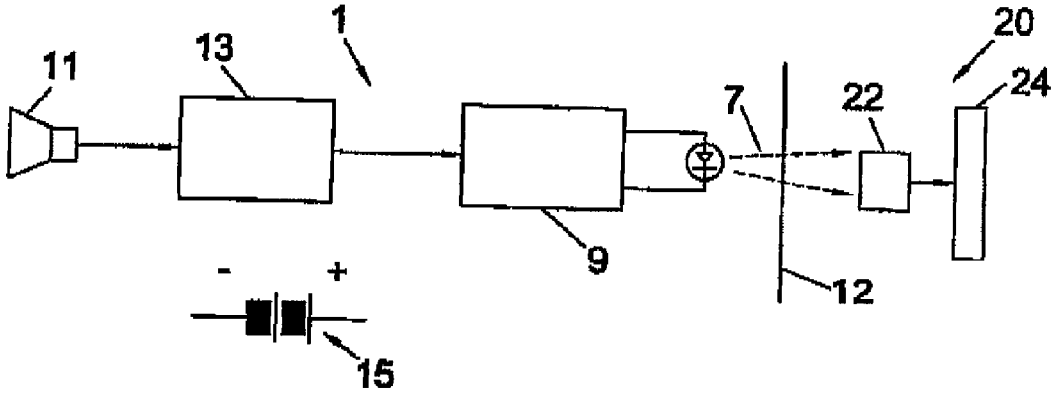
FIG. 2 shows a block diagram identifying the components of the ear canal module and ear implant of the present invention.

FIG. 2 shows in more detail the components of the ear module 1 and implant 20 of the present invention. The ear module 1 comprises a microphone 11, and associated electronic circuiting 13 for transducing sound into an electrical signal which is in turn converted and transmitted as the modulated light signal 7 (shown as broken arrows) by the LED 9. Power for the ear module is provided by a battery 15. The modulated light signal 7 passes through the ear drum 12 and is detected by a photodiode 22 of implant 20. The photodiode 22 converts the light signal 7 into an electrical signal for driving/oscillating a disk actuator 24 made of PZT piezo ceramic material.

Advantageously the hearing system features surgical simplicity, safety and life-long durability (no implanted battery needs to be replaced), easy updating of signal processing (external module) algorithms, minimum or no deterioration (destruction) of the residual hearing level, minimum or no acoustic feedback and canal occlusion problems which are inherent with conventional hearing aids, low-cost and acceptability for both the surgeons and the patients.

To illustrate the efficacy of the present invention, the inventors have tested the feasibility of two components of the invention ie. the ossicular mounted piezoelectric actuator and the infrared telemetry system.

We have tested the feasibility of the two key innovations in this project, i.e. the ossicular mounted piezoelectric actuator and the infrared telemetry system.

(a) Ossicular mounted piezoelectric actuator. An ossicular mounted actuator is used in the Soundbridge implant [1], but it has an electromagnetic actuator with a moving mass component, so the vibrating mechanism is not directly comparable with the presently proposed design. The piezoelectric actuator used for the pilot study was an 8 mm diameter single layer disk bender, of the type used in the TICA hearing implant (2). The output vibration level of the TICA actuator is well documented and has been shown clinically to satisfy the requirements of a hearing implant [2]. This makes it suitable for demonstrating the ossicular mounted concept. The actuator is available commercially (American Piezo Company). Its total thickness is 0.22 mm and its mass is less than 150 mg.

Figure 3:
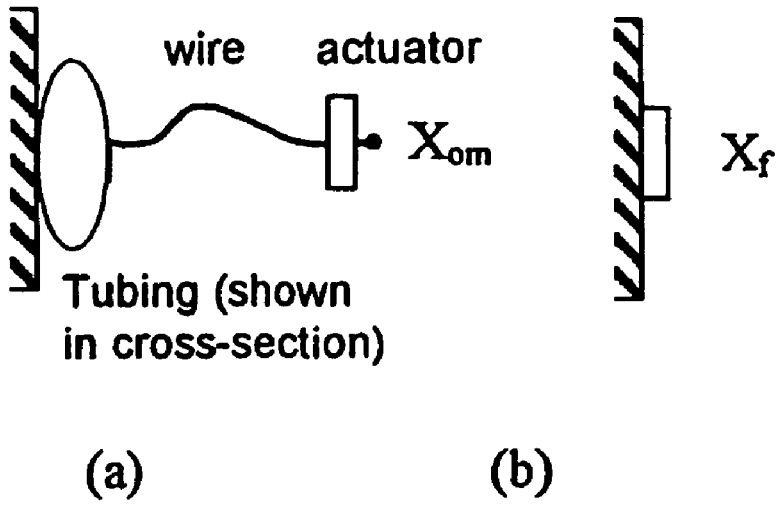
FIG. 3 is a schematic depiction of a testing system used to evaluate the present invention.
Figure 4:
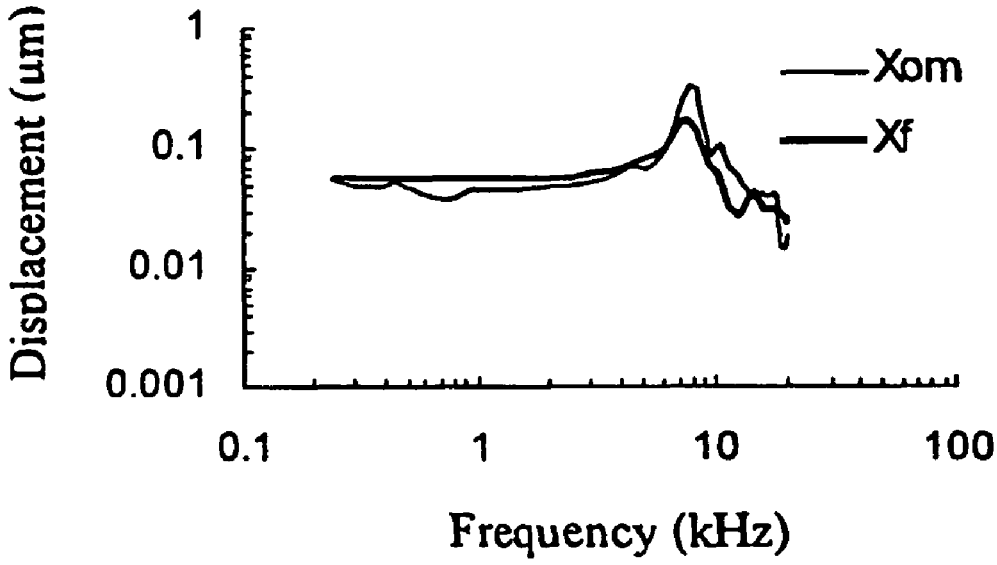
FIG. 4 is a graphic depiction of displacement versus frequency as measured using the test apparatus of FIG. 3.

FIG. 3 shows a schematic of the test configuration, which was designed to be a more demanding load than the real ossicular chain. A copper wire was used to simulate the ossicular chain. It was glued at one end to a 17 mm long section of flexible plastic sleeving (polyolefin, 12.7 mm bore, 0.3 mm thick, weight 0.36 g), giving a crude representation of the eardrum. The wire weighed 60 mg, which is about 10% heavier than the ossicular chain [3]. The other side of the tube was glued to a solid framework. The wire passed through the centre of the actuator, with a tight fit to hold it in place. The protruding wire weighed about 8 mg, twice the weight of the stapes. Reference data were obtained for an unloaded actuator, which was attached around its circumference to a solid framework, FIG. 3(*b*). Vibration was measured with a laser vibrometer. FIG. 4 shows the measured displacements.

The TICA is reported as producing 22 nm at 2.83V peak to peak [2], which was found to be equivalent to around 100 dB SPL at 1 kHz and more than 130 dB SPL (Sound Pressure Level) at higher frequencies [2]. The 'ossicular mounted' actuator of the present invention gave a nearly flat response of 47 nm below 4 kHz at 1V excitation, considerably higher than the TICA, and a similar resonant frequency of 7-10 kHz.

(b) Infrared light transmission. Light transmission was tested through a chicken skin, which is more opaque than the eardrum and at least twice as thick. The simulation was otherwise as realistic as possible, in terms of the likely size of the light emitting diode (LED) source and the distances for the light path. The energy detected by a photodiode was used to drive the disk bender actuator and could produce a vibration displacement level equivalent to 100 dB SPL, which is more than adequate for an implant, using 2.1 mW optical power. A custom made actuator is envisaged to perform much better. The level of infrared energy used was less than 1% of the level that could cause tissue damage, according to British Standard EN 60825-1: 1994 Safety of Laser Products. This demonstrates the viability of the trans-eardrum telemetry concept.

REFERENCES

[1] Lenarz T, Weber B P, Mack K F, Battmer R D, Gnadeberg D. The Vibrant Soundbridge System: a new kind of hearing aid for sensorineural hearing loss. 1: Function and initial clinical experiences. Laryngorhinootologie. 1998; 77: 247-55. (In German).

[2] Zenner H P, Leysieffer H, Maassen M, et al. Human Studies of a Piezoelectric Transducer and a Microphone for a Totally Implantable Electronic Hearing Device. American Journal of Otology, 2000; 21: 196-204.

[3] Kirkae I. The structure and function of the middle ear. University of Tokyo Press, Tokyo, 1960.

The invention claimed is:

1. A hearing aid system comprising:

an ear canal module for location in the ear canal of a user, the ear canal module comprising a microphone for converting sound into an electrical signal and a light source for converting said electrical signal into a light signal and for transmitting said light signal to the middle or inner ear of the user; and an implant for location in the middle or inner ear of a user, the implant comprising a photoreceiver and a hearing actuator, the photoreceiver being operative to detect the light signal transmitted from the ear canal module and convert said light signal into a further electrical signal for driving the hearing actuator;

wherein, in use, light signals transmitted from the ear canal module constitute the sole input to the implant.

2. The hearing aid system according to claim 1 wherein the ear canal module comprises a further light source for transmitting a further light signal for charging a battery within the implant, the battery serving to provide additional power to the implant.

3. The hearing aid system according to claim 1 wherein the components of the microphone and the light source are contained within a single housing which is shaped to fit within the ear canal of the user.

4. The hearing aid system according to claim 1 wherein the light source is a light emitting diode (LED).

5. The hearing aid system according to claim 1 wherein the light signal is near infrared (NIR) light or infrared (IR) energy.

6. The hearing aid system according to claim 1 wherein a channel or a valve is provided in the module so as to provide a passage through the module thereby preventing blockage of the ear canal.

7. The hearing aid system according to claim 1 wherein the implant is an integrated photoreceiver/actuator unit.

8. The hearing aid system according to claim 7 wherein the integrated photoreceiver actuator unit is a micro electromechanical system (MEMS)-integrated photoreceiver/actuator.

9. The hearing aid system according to claim 1 wherein the photoreceiver is a photo-sensitive diode or photovoltaic cell.

10. The hearing aid system according to claim 1 wherein the hearing actuator is arranged in use to contact the ossicular chain.

11. The hearing aid system according to claim 10 wherein the hearing actuator is located on the incus long process, the incodostapedial joint or the stapes.

12. The hearing aid system according to claim 10 wherein the actuator is arranged in use to be positioned in the middle ear.

13. The hearing aid system according to claim 10 wherein the hearing actuator is secured in place by cementing, grafting or by mechanical means.

14. The hearing aid system according to claim 1 wherein actuation of the middle or inner ear compounds is by mechanical or electrical means.

15. The hearing aid system according to claim 14 wherein actuation is by mechanical means, wherein the actuator is in the form of a thin disk or disk made of piezo ceramic material.

16. The hearing aid system according to claim 15 wherein the piezo ceramic material is lead zirconate titanate (PZT) or PLZT.

17. The hearing aid system according to claim 14 wherein actuation is by mechanical means, wherein the hearing actuator comprises a flexible diaphragm.

* * * * *